United States Patent [19]

Paspek et al.

[11] Patent Number: 5,068,027

[45] Date of Patent: Nov. 26, 1991

[54] PROCESS FOR UPGRADING HIGH-BOILING HYDROCARONACEOUS MATERIALS

[75] Inventors: Stephen C. Paspek, North Royalton; Jeffrey B. Hauser, Middleburgh Hgts.; Christopher P. Eppig, Cleveland Hts.; Harry A. Adams, Bedford, all of Ohio

[73] Assignee: The Standard Oil Company, Cleveland, Ohio

[21] Appl. No.: 482,255

[22] Filed: Feb. 20, 1990

[51] Int. Cl.[5] ..... C10G 9/26; C10G 9/42

[52] U.S. Cl. ..... 208/125; 208/106; 208/132; 208/48 R

[58] Field of Search ..... 208/125, 106, 255, 299, 208/48 R, 130, 132, 106, 125

[56] References Cited

U.S. PATENT DOCUMENTS

| | | | |
|---|---|---|---|
| 2,271,097 | 1/1942 | Ruthruff et al. | 196/49 |
| 2,428,666 | 10/1947 | Hemminger | 196/52 |
| 2,743,214 | 4/1956 | Guernsey | 208/141 |
| 2,847,359 | 8/1958 | Beuther et al. | 196/50 |
| 2,900,327 | 8/1959 | Beuther | 208/106 |
| 3,172,840 | 3/1965 | Paterson | 208/79 |
| 3,369,994 | 2/1968 | Slater et al. | 208/58 |
| 3,580,838 | 5/1971 | Lutz | 208/100 |
| 4,042,486 | 8/1977 | Seguchi et al. | 208/48 R |
| 4,057,490 | 11/1977 | Wynne, Jr. | 208/127 |
| 4,080,285 | 3/1978 | McKinney et al. | 208/127 |
| 4,213,846 | 7/1980 | Sooter et al. | 208/50 |
| 4,298,455 | 11/1981 | Huang | 208/106 |
| 4,547,284 | 10/1985 | Ize et al. | 208/50 |
| 4,587,007 | 5/1986 | Rudnick | 208/125 |
| 4,604,186 | 8/1986 | Lutz et al. | 208/50 |
| 4,663,019 | 5/1987 | Gartside et al. | 208/50 |
| 4,778,586 | 10/1988 | Bain et al. | 208/132 |
| 4,784,746 | 11/1988 | Farcasiu et al. | 208/106 |
| 4,828,678 | 5/1989 | Venkat et al. | 208/125 |
| 4,840,725 | 6/1989 | Paspek | 208/130 |
| 4,869,804 | 9/1989 | Le Perchec et al. | 208/125 |
| 4,877,513 | 10/1989 | Haire et al. | 208/106 |

*Primary Examiner*—Helane E. Myers

*Attorney, Agent, or Firm*—Larry W. Evans; David J. Untener; Scott A. McCollister

[57] ABSTRACT

This invention relates to a process for upgrading a hydrocarbonaceous material having an initial boiling point of at least about 625° F. to a product having a lower boiling point than the initial boiling point of said hydrocarbonaceous material and/or a higher boiling point than the final boiling point of said hydrocarbonaceous material, the process comprising heating a mixture comprising said hydrocarbonaceous material and at least one organic solvent in an enclosed space in the absence of externally supplied water or hydrogen at a temperature in the range of about 750° F. to about 1300° F. and a pressure in excess of about 1200 psig for an effective period of time to yield said product, said pressure being sufficient to maintain the specific gravity of the contents of said enclosed space in the range of about 0.05 to about 1.5, said organic solvent being capable of dissolving at least about 10 parts of said hydrocarbonaceous material per million parts of said organic solvent at the temperature wherein at least about 50% by weight of said organic solvent boils at atmospheric pressure.

43 Claims, No Drawings

PROCESS FOR UPGRADING HIGH-BOILING HYDROCARONACEOUS MATERIALS

TECHNICAL FIELD

This invention relates to a process for upgrading high-boiling hydrocarbonaceous materials to lower and/or higher boiling materials.

BACKGROUND OF THE INVENTION

In many delayed coking processes heavy gas oil boiling in the range of about 625° F. to about 900° F. at atmospheric pressure is the heaviest liquid drawn off the coker fractionator. This material is usually subjected to treatment in fluid catalytic crackers for conversion to lighter products. However, due to the refractory nature of heavy gas oil, treatment of such material in such fluid catalytic crackers is often harmful to the catalysts used therein. The detrimental affect on the catalysts affects not only the heavy gas oil being treated in the fluid catalytic cracker, but also other refinery streams that may be co-fed to the cracker. The practice of cracking heavy gas oil in fluid catalytic crackers continues to be a significant practice in many refineries due to the lack of other reliable options available to such refineries. It would be advantageous if a process could be developed for upgrading heavy gas oil as well as similar hydrocarbonaceous materials without having to do so in a fluid catalytic cracker.

U.S. Pat. No. 2,271,097 discloses a process for converting high boiling hydrocarbons into lower boiling hydrocarbons. The process includes the step of heating the bottoms from a fractionator in a viscosity breaker at a temperature of 850°-950° F. and a pressure of 75-500 psig.

U.S. Pat. No. 3,172,840 discloses a process for converting hydrocarbonaceous materials such as petroleum oils to gasoline and middle distillates. The process includes the step of cracking a product stream boiling in the range of 750°-950° F. from a coker bubble tower in a thermal cracking furnace at a temperature of 850°-1000° F. and a pressure of 300-1000 psig.

U.S. Pat. No. 4,213,846 discloses a delayed coking process that employs a hydrotreating step wherein gas oil from the coker fractionator is hydrotreated at a temperature of 315°-400° C. (599°-752° F.) and a hydrogen partial pressure of 350-2000 psig.

U.S. Pat. No. 4,784,746 discloses a process for upgrading crude oil (whole crude or topped crude) by combining the crude oil with a low boiling component that boils below 330° F. and has an aromatic content of at least 20%, then heating the resulting mixture at 400°-500° C. (752°-932° F.) and a pressure sufficient to maintain the feed stream in the liquid phase. The reference discloses pressures in the range of 100-1000 psig. The process is conducted for an effective period of time to increase the proportion of non-residual components in the crude oil using a transalkylation process.

U.S. Pat. No. 4,840,725 discloses a process for converting high boiling hydrocarbons to lower boiling material characterized by an increase in aromatic content and a lower pour point which comprises contacting said high boiling hydrocarbons with water at a temperature of from about 600° F. to about 875° F. and a pressure of at least about 2000 psi in the absence of any externally supplied catalysts, and wherein the weight ratio of water to high boiling hydrocarbons is from about 0.5:1 to about 1:1, and the water and high boiling hydrocarbon form a substantially single phase system under the elevated temperature and pressure conditions used.

SUMMARY OF THE INVENTION

This invention relates to a process for upgrading a hydrocarbonaceous material having an initial boiling point at atmospheric pressure of at least about 625° F. to a product having a lower boiling point than the initial boiling point of said hydrocarbonaceous material and/or a higher boiling point than the final boiling point of said hydrocarbonaceous material, the process comprising heating a mixture comprising said hydrocarbonaceous material and at least one organic solvent in an enclosed space in the absence of externally supplied water or hydrogen at a temperature in the range of about 750° F. to about 1300° F. and a pressure in excess of about 1200 psig for an effective period of time to yield said product, said pressure being sufficient to maintain the specific gravity of the contents of said enclosed space in the range of about 0.05 to about 1.5, said organic solvent being capable of dissolving at least about 10 parts of said hydrocarbonaceous material per million parts of said organic solvent at the temperature wherein at least about 50% by weight of said organic solvent boils at atmospheric pressure.

DESCRIPTION OF THE PREFERRED EMBODIMENTS

It has now been found that hydrocarbonaceous materials having initial boiling points above about 625° F. can be upgraded to valuable low and/or high boiling products by subjecting a mixture of the hydrocarbonaceous material and at least one organic solvent to heat treatment in a relatively narrow temperature range under sufficient pressure to maintain the density of the reactants and resulting upgraded products at a relatively high level until the desired level of reaction is complete.

The hydrocarbonaceous materials that can be subjected to the inventive process include, for example, heavy gas oil, residual oil (e.g., petroleum oil fractions), bitumen, and other high-boiling or heavy hydrocarbon oils. The hydrocarbonaceous material can be aliphatic, alicyclic, aromatic or a mixture thereof and has an initial boiling point at atmospheric pressure of at least about 625° F. In one embodiment of the invention the initial boiling point of the hydrocarbonaceous material at atmospheric pressure is at least about 700° F.; in another embodiment it is at least about 800° F.; in another embodiment it is at least about 900° F.; and in another embodiment it is at least about 1000° F. In one embodiment, the hydrocarbonaceous material has an initial boiling point at atmospheric pressure in the range of about 700° F. to about 1100° F. In one embodiment, the hydrocarbonaceous material has an initial boiling point at atmospheric pressure in the range of about 625° F. to about 850° F. and a final boiling point at atmospheric pressure in the range of about 700° F. to about 1000° F. In one embodiment the hydrocarbonaceous material has an initial boiling point at atmospheric pressure in the range of about 700° F. to about 950° F. and a final boiling point at atmospheric pressure in the range of about 900° F. to about 1100° F. In one embodiment the hydrocarbonaceous material has an initial boiling point at atmospheric pressure in the range of 750° F. to about 1000° F. and no final boiling point; that is, at least some of the hydrocarbonaceous material treated in this embodiment of the invention does not boil. In one embodiment the hydrocarbonaceous material is other than crude oil, e.g., whole or topped crude oil.

The organic solvent used in the inventive process is capable of dissolving at least about 10 parts of the hydrocarbonaceous material being treated per million parts of said organic solvent at the temperature wherein at least about 50% by weight of said organic solvent boils at atmospheric pressure. These solvents include aromatic compounds, cycloaliphatic compounds, aliphatic-substituted aromatic compounds, cycloaliphatic-substituted aromatic compounds, aliphatic-substituted cycloaliphatic compounds, and mixtures thereof. Hydrocarbons that are substituted with non-hydrocarbon groups (e.g., halo, hydroxy, nitro, cyano, alkoxy, acyl, etc.) can be used. Hydrocarbons containing hetero atoms (e.g., nitrogen, oxygen, sulfur) in a chain or ring are useful. The aromatic compounds can be mononuclear (e.g., benzene) or polynuclear (e.g., naphthalene, anthracene, etc.). The aliphatic substituents on the aromatic compounds can be straight chain hydrocarbon groups of 1 to about 20 carbons, cyclic groups of about 3 to about 6 carbons, or mixtures thereof. The aromatic compounds can be mono-substituted or poly-substituted. Examples include toluene, the xylenes, ethyl benzene, cyclohexyl benzene, etc. The cycloaliphatic compounds can have from about 3 to about 6 ring carbon atoms, preferably 5 or 6 ring carbon atoms, and can be saturated or unsaturated. Examples include cyclohexane, cyclohexene, 1,3-cyclohexadiene, decahydronaphthalene, etc. The aliphatic substituents on the aliphatic-substituted cycloaliphatic compounds can be straight chain hydrocarbon groups of 1 to about 20 carbon atoms. The rings of the cycloaliphatic compounds can be mono-substituted or poly-substituted. Examples include methylcyclopentane, methylcyclohexane, 1,3-dimethylcyclohexane, 3-ethylcyclopentene, 3,5-dimethylcyclopentene, $C_{1-20}$ alkyl or alkenyl-substituted decahydronaphthalenes, etc.

The organic solvent preferably has an initial boiling point at atmosphere pressure in the range of about 0° F. to about 500° F., and a final boiling point at atmospheric pressure in the range of about 200° F. to about 1000° F. These solvents can have an aromatic content in excess of about 25% by weight, and in many instances they have an aromatic content in excess of about 50% by weight. In one embodiment, this solvent has an initial boiling point at atmospheric pressure in the range of about 50° F. to about 150° F., and a final boiling point at atmospheric pressure in the range of about 200° F. to about 300° F. In one embodiment, this solvent has an initial boiling point at atmospheric pressure in the range of about 180° F. to about 280° F., and a final boiling point at atmospheric pressure in the range of about 325° F. to about 425° F. In one embodiment, this solvent has an initial boiling point at atmospheric pressure in the range of about 200° F. to about 325° F., and a final boiling point at atmospheric pressure in the range of about 425° F. to about 525° F. In one embodiment, this solvent has an initial boiling point at atmospheric pressure in the range of about 300° F. to about 500° F., and a final boiling point at atmospheric pressure in the range of about 650° F. to about 950° F. In one embodiment, at least about 50% by weight, more preferably at least about 75% by weight, more preferably at least about 90% by weight, of this solvent boils at a temperature below about 750° F. at atmospheric pressure, and all or substantially all of said solvent boils at a temperature below about 1000° F. at atmospheric pressure. In one embodiment, this solvent has an initial boiling point at atmospheric pressure in the range of about 200° F. to about 325° F., preferably about 260° F. to about 290° F., a 90% by weight boiling point at atmospheric pressure in the range of about 350° F. to about 450° F., preferably about 380° F. to about 420° F. (that is, 90% by weight of the solvent boils at a temperature below about 350° F. to about 450° F. at atmospheric pressure), and a final boiling point at atmospheric pressure in the range of about 425° F. to about 525° F., preferably about 460° F. to about 490° F.; this solvent preferably contains in excess of about 50% by weight aromatics, more preferably in excess of about 75% by weight aromatics, more preferably in excess of about 90% by weight aromatics. In one embodiment, this solvent has an initial boiling point at atmospheric pressure in the range of about 300° F. to about 500° F., preferably about 360° F. to about 420° F., a final boiling point at atmospheric pressure in the range of about 650° F. to about 950° F., preferably about 720° F. to about 850° F.; this solvent preferably has an aromatic content in excess of about 45% by volume, more preferably in the range of about 50% to about 90% by volume, more preferably about 60% to about 80% by volume. Mixtures of two or more of the foregoing solvents can be used.

The organic solvent can be an aromatic or aromatic-rich solvent that is readily available from a refinery system such as, for example, one or more reformates (e.g., light reformate, heavy reformate, etc.) that are produced by reformers in a typical refinery system. A typical light reformate has an initial boiling point at atmospheric pressure in the range of about 50° F. to about 150° F., a final boiling point at atmospheric pressure in the range of about 250° F. to about 350° F., and contains benzene and toluene. A typical heavy reformate has an initial boiling point at atmospheric pressure in the range of about 250° F. to about 350° F., a final boiling point at atmospheric pressure in the range of about 450° F. to about 550° F., and contains toluene, ethylbenzene, o-xylene and p-xylene.

The organic solvent can be a middle distillate (i.e., straight run distillate or processed distillate) such as fuel oil (e.g., diesel oil, etc.), kerosene, naphtha, gas oil (e.g., light gas oil, heavy gas oil, etc.) cycle oil, decanted oil and the like. Mixtures of two or more of the foregoing can be used. The organic solvent can be a natural gas condensate comprising hydrocarbons of about 6 to about 25 carbon atoms and having an aromatic and/or naphthene content of about 5% to about 90% by weight.

The hydrocarbonaceous material being treated is preferably mixed with an effective amount of organic solvent to improve the handling (e.g., pumping) characteristics of the hydrocarbonaceous material, reduce coke formation in the final product, and/or improve selectivity in the final product to desired low-boiling fractions. Mixing of the hydrocarbonaceous material and solvent can be effected prior to and/or during treatment. Thus, for example, if a flow-through reactor is used, the solvent can be mixed with the hydrocarbonaceous feed material prior to entry into the reactor; or part of the solvent can be mixed with the feed prior to entry into the reactor and part can be added to the reactor contents at one or more entry points along the length of the reactor; or all of the solvent can be added at one or more entry points along the length of the reactor. The weight ratio of organic solvent to hydrocarbonaceous material being treated preferably ranges from about 0.01 to about 10:1. The weight ratio of organic solvent to hydrocarbonaceous material can range from about 0.01:1 to about 3:1, more preferably about 0.05:1 to about 1:1, more preferably about 0.05:1 to about 0.5:1, more preferably about 0.05:1 to about 0.3:1.

The inventive process is carried out in the absence of externally supplied water or hydrogen. In one embodiment of the invention, the inventive process is carried out in the absence of externally supplied catalysts.

The operating temperature is preferably in the range of about 750° F. to about 1300° F., more preferably about 850° F. to about 1300° F., more preferably about 950° F. to about 1300° F.

The operating pressure is preferably at least about 1200 psig, more preferably at least about 1500 psig, more preferably at least about 1800 psig, more preferably at least about 2000 psig. A practical upper limit on pressure is about 10,000 psig, and upper limits of about 6000 psig, more preferably about 4000 psig are useful. The reaction is typically conducted at pressures in the range of about 1200 to about 10,000 psig, more preferably about 1200 to about 6000 psig, more preferably about 1500 to about 4000 psig, more preferably about 1800 to about 3000 psig.

An important and critical feature of the invention is that the operating temperature and pressure must be sufficient to maintain the specific gravity of the reactor contents (i.e., feed and converted product) under reaction conditions in the range of about 0.05 to about 1.5, more preferably about 0.1 to about 1.2, more preferably about 0.1 to about 1, more preferably about 0.1 to about 0.8, more preferably about 0.1 to about 0.5. In a reactor wherein more than one phase is present (e.g., liquid and gas) the foregoing figures refer to the specific gravity of the lowest-density phase (e.g., gaseous phase in a two-phase system consisting of liquid and gas). In a reactor wherein the pressure is maintained at a constant or substantially constant level (e.g., flow-through reactor) there is a tendency for the specific gravity of the reactor contents to decrease as the reaction progresses, and in such a reactor it is preferred that the specific gravity of the reactor contents be maintained in the foregoing ranges at or near the reactor exit. In one embodiment of the invention, the specific gravity is maintained at a sufficient level to maintain at least part of the reactor contents in liquid phase.

The specific gravity of the reactor contents under reaction conditions can be measured using known techniques. For example, flow from the reactor can be diverted to a tube having a fixed volume; the tube is cooled and weighed and the specific gravity is calculated from this measurement.

The reaction is conducted generally for a period of time which is sufficient to provide the desired conversion of the hydrocarbonaceous material to low and/or high boiling materials. The time of the reaction will, of course, vary depending upon the temperature, pressure and the specific hydrocarbonaceous material being treated. For example, at the lower temperatures and pressures, the reaction time will be longer whereas at the higher temperatures and pressures, the time required to obtain the desired conversion is reduced. The three factors of temperature, pressure and time can be varied as determined by one skilled in the art. Depending on these factors, the reaction time may be as short as a few seconds, more generally from about one minute to about one hour. In one embodiment, the reaction time is up to about 10 minutes, preferably from about 1 to about 10 minutes.

The process of the invention can be conducted either as a batch, semi-batch or continuous process. When a batch process is utilized, the hydrocarbonaceous material is added to a reaction vessel such as an autoclave. The autoclave then is sealed and heated to the desired operating temperature and pressure, and when the operating temperature and pressure are reached, they are maintained for the allotted period of time to effect the desired degree of reaction. Generally, a period of from about one minute to about one hour, more preferably about one to about 10 minutes, is adequate to provide the desired degree of conversion to high and/or low boiling materials. The reactor then is cooled, for example, to room temperature, the pressure is released and the reactor is emptied. The desired low and/or high boiling fractions can be isolated and recovered using known techniques such as by distillation or by chromatographic techniques. A semi-batch process is similar to a batch process except that at least some of the product is removed from the reactor on a continuous or semi-continuous basis as it is generated, and/or at least some of the feed composition enters the reactor on a continuous or a semi-continuous basis.

When a continuous process is utilized, the reaction product obtained from the reactor is collected and the desired low and/or high boiling fractions are isolated and separated. The product or parts thereof, such as desired boiling fractions, can be recycled to the reactor where the recycled material is, in effect, subjected to a second thermal treatment, and further conversion and recovery of desirable low and/or high boiling materials is achieved. The solvent can be separated from the product using known techniques and recycled.

The process of the present invention has a number of advantages over the prior art. The process produces desirable low and/or high boiling products under relatively mild conditions. The amount of coke produced inside the reactor as the result of the process of the invention is reduced. The reduction of coke formation is a significant benefit since coke tends to foul conventional reactors, and where coke is produced, the reactors must be shut down regularly and cleaned. The reduction in the amount of coke formed means that these reactors are capable of being operated continuously for longer periods.

The inventive process is useful in that it produces product boiling below the initial boiling point of the feed and/or product boiling above the final boiling point of the feed. The former is useful in providing lighter, more useful hydrocarbon fractions such as fuel range liquids. The latter is useful in providing useful products such as premium needle coke.

The inventive process is also useful in that is produces a product having a relatively low olefin content. The low olefin content of such product provides it with stability in that the formation of polymers, gums, sludges, color bodies, etc., in said product is eliminated or minimized. In one embodiment of the invention the product produced by the inventive process has an olefin content of preferably less than about 5% by weight, more preferably less than about 2% by weight, more preferably less than about 1% by weight.

The following examples are illustrative of the process of the present invention. Unless otherwise indicated, in the following examples as well as throughout the entire specification and in the appended claims, all parts and percentages are by weight, all boiling points are at atmospheric pressure, and all temperatures are in degrees Fahrenheit. Also, unless otherwise indicated, all specific gravities refer to the density of the materials for which the specific gravity is expressed, divided by the density of water at 4° C.

EXAMPLE 1

A flow system having a feed pump, flow through preheater-reactor, and product collection vessel is set up for converting a hydrocarbonaceous feed material to lower and/or higher boiling materials. The feed pump is a dual barrel syringe pump having a rating of 5000 psig, flow rates being variable from 1 to 15 cc/minute. The feed is delivered to the pump from a ten-gallon feed tank under a nitrogen pressure of 25 psig. The preheater-reactor is a continuous coil of ¼ inch 316 stainless steel tubing immersed in a fluidized sand bath. Reactor volumes are varied from 20 to 100 cc by changing the length of the tubing. The product collection vessel is a one-liter autoclave. A water-cooled heat exchanger is positioned between the preheater-reactor and the product collection vessel to cool product flowing from the preheater-reactor to the product collection vessel. The product collection vessel is pre-pressurized with nitrogen to the reaction pressure prior to the start of a run. As liquid accumulates in the product collection vessel, nitrogen is displaced through a back pressure regulator. Fixed gases are measured through a dry test meter. Liquid samples are periodically withdrawn from the bottom of the product collection vessel.

In operation, the system is pre-pressurized with nitrogen to the operating pressure. The sand bath is brought up to the operating temperature. The feed pump is charged with the feed material and started. A pre-run of 200–500 cc is conducted, then the product collection vessel is drained, and the recovery run is commenced. After the contents of one barrel of the syringe pump are fed to the reactor, the second barrel is brought on line, and the first barrel is refilled. At the end of the recovery run, the product receiver is drained, and the dry test meter and syringe pump readings are noted. Product oil conversion is measured gravimetrically. The system is depressurized and residual oil is blown from the preheater-reactor coil with nitrogen. The coil is removed from the sand bath, cooled and weighed to determine coke yield.

Using the foregoing apparatus and procedure, a series of test runs is conducted using a mixture of (1) residual oil, 15–20% by weight of which boils at atmospheric pressure in the range of 800–1000° F. and the remainder boils at temperatures in excess of 1000° F. at atmospheric pressure; and (2) toluene. The temperature, pressure and time for each test run are reported in Table I. The specific gravity of the contents of the preheater-reactor coil at the exit of said preheater-reactor coil for each test run is reported in Table I. The net yield of gas, liquid and coke in the product is reported in Table I; these yields are expressed in terms of weight percent based on the weight of residual oil fed to the system. Analysis of the liquid product with toluene removed is reported in Table I. The time reported in Table I is the space time of feed and converted product in the preheater-reactor coil.

TABLE I

| Test Run | A | B | C | D | E | F | G |
|---|---|---|---|---|---|---|---|
| Temp., °F. | 896 | 896 | 914 | 932 | 914 | 905 | 896 |
| Pressure, psig | 2500 | 2500 | 2500 | 2500 | 2500 | 2500 | 2500 |
| Time, min. | 5 | 3 | 5 | 5 | 5 | 5 | 5 |
| Specific Gravity | 0.4–0.5 | 0.4–0.5 | 0.4–0.5 | 0.4–0.5 | 0.4–0.5 | 0.4–0.5 | 0.4–0.5 |
| Feed: | | | | | | | |
| Residual oil, wt. % | 90 | 90 | 90 | 90 | 91 | 91 | 90 |
| Toluene, wt. % | 10 | 10 | 10 | 10 | 9 | 9 | 10 |
| Product: | | | | | | | |
| Gas, wt. % | 4 | 3 | 6 | 7 | 2 | 1 | 0 |
| Liquid, wt. % | 95 | 96 | 92 | 89 | 95 | 98 | 99 |
| Coke, wt. % | 1 | 1 | 3 | 5 | 3 | 1 | 0.6 |
| Liquid Product: | | | | | | | |
| IPB–350° F., wt. % | 7 | 3 | 14 | 13 | 14 | 11 | 10 |
| 350–450° F., wt. % | 6 | 2 | 7 | 8 | 7 | 6 | 4 |
| 450–625° F., wt. % | 11 | 8 | 12 | 12 | 16 | 12 | 12 |
| 625–900° F., wt. % | 26 | 23 | 20 | 20 | 24 | 26 | 26 |
| 900° F.+, wt. % | 50 | 64 | 47 | 47 | 39 | 45 | 48 |

EXAMPLE 2

A series of tests is conducted using a mixture of (1) bitumen, 40–50% by weight of which boils in the range of 800°–1000° F. and the remainder boils at temperatures in excess of 1000° F. at atmospheric pressure; and (2) the solvent indicated in Table II. The same apparatus and procedure used in Example 1 is used. The space time of the feed and converted products in the preheater-reactor coil for each test run is reported in Table II. All test runs are conducted at 914° F. and 2500 psig. The specific gravity of the contents of the preheater-reactor coil at the exit of said preheater-reactor coil for each test run is 0.4–0.5. The net yield of gas, liquid and coke in the product is reported in Table II, these yields being expressed in terms of weight percent based on the weight of bitumen fed to the system. Analysis of the liquid product with solvent removed is reported in Table II.

TABLE II

| Test Run | A | B | C | D | E | F |
|---|---|---|---|---|---|---|
| Time, min. | 3.1 | 3.1 | 3.1 | 3.1 | 3.0 | 5.0 |
| Feed: | | | | | | |
| Bitumen, wt. % | 85 | 85 | 85 | 85 | 77 | 77 |
| Solvent, wt. % | 15[a] | 15[b] | 15[c] | 15[d] | 23[e] | 23[e] |
| Product: | | | | | | |
| Gas, wt. % | 1 | 0 | 1 | 1.2 | 0 | 0 |
| Liquid, wt. % | 98 | 97 | 98 | 97 | 99 | 97 |
| Coke, wt. % | 0.3 | 3 | 0.5 | 1.3 | 1 | 3 |
| Liquid Product: | | | | | | |
| IPB–380° F., wt. % | 19 | 19 | 19 | 19 | 16 | 20 |
| 380–520° F., wt. % | 7 | 7 | 9 | 18 | 14 | 15 |

TABLE II-continued

| Test Run | A | B | C | D | E | F |
|---|---|---|---|---|---|---|
| 520–700° F., wt. % | 20 | 20 | 22 | 26 | 20 | 19 |
| 700–1000° F., wt. % | 29 | 29 | 31 | 22 | 25 | 24 |
| 1000° F.+, wt. % | 25 | 25 | 19 | 15 | 25 | 22 |

[a]Heavy reformate having initial boiling point of 230° F., final boiling point of 375° F., and containing toluene, ethylbenzene, o-xylene and p-xylene.
[b]Mixture of heavy reformate used in Test Run A and n-pentane, the weight ratio of reformate to n-pentane being 2:1.
[c]Mixture of heavy reformate used in Test Run A and n-hexene, the weight ratio of reformate to n-hexene being 13:2.
[d]Heavy gas oil boiling in range of 625–900° F.
[e]Toluene.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A process for upgrading a hydrocarbonaceous material having an initial boiling point at atmospheric pressure of at least about 625° F. to a product having a lower boiling point than the initial boiling point of said hydrocarbonaceous material and/or a higher boiling point than the final boiling point of said hydrocarbonaceous material, the process comprising heating a mixture comprising said hydrocarbonaceous material and at least one organic solvent in an enclosed space in the absence of externally supplied water or hydrogen at a temperature in the range of about 750° F. to about 1300° F. and a pressure in excess of about 1500 psig for an effective period of time to yield said product, said pressure being sufficient to maintain the specific gravity of the contents of said enclosed space in the range of about 0.05 to about 1.5, said organic solvent being capable of dissolving at least about 10 parts of said hydrocarbonaceous material per million parts of said organic solvent at the temperature wherein at least about 50% by weight of said organic solvent boils at atmospheric pressure.

2. The process of claim 1 wherein said specific gravity is in the range of about 0.1 to about 1.2.

3. The process of claim 1 wherein said specific gravity is in the range of about 0.1 to about 1.

4. The process of claim 1 wherein said specific gravity is in the range of about 0.1 to about 0.5.

5. The process of claim 1 wherein said pressure is in excess of about 1800 psig.

6. The process of claim 1 wherein said pressure is in the range of about 1500 to about 4000 psig.

7. The process of claim 1 wherein said pressure is in the range of about 1800 to about 3000 psig.

8. The process of claim 1 wherein said temperature is in the range of about 850° F. to about 1300° F.

9. The process of claim 1 wherein said temperature is in the range of about 950° F. to about 1300° F.

10. The process of claim 1 wherein said hydrocarbonaceous material comprises residual oil.

11. The process of claim 1 wherein said hydrocarbonaceous material comprises bitumen.

12. The process of claim 1 wherein said hydrocarbonaceous material has an initial boiling point at atmospheric pressure of at least about 700° F.

13. The process of claim 1 wherein said hydrocarbonaceous material has an initial boiling point at atmospheric pressure of at least about 800° F.

14. The process of claim 1 wherein said hydrocarbonaceous material has an initial boiling point at atmospheric pressure in the range of about 625° F. to about 850° F. and a final boiling point at atmospheric pressure in the range of about 700° F. to about 1000° F.

15. The process of claim 1 wherein said hydrocarbonaceous material has an initial boiling point at atmospheric pressure in the range of about 700° F. to about 950° F. and a final boiling point at atmospheric pressure in the range of about 900° F. to about 1100° F.

16. The process of claim 1 wherein said hydrocarbonaceous material has an initial boiling point at atmospheric pressure in the range of about 750° F. to about 1000° F. and no final boiling point.

17. The process of claim 1 wherein said organic solvent comprises at least one aromatic compound, cycloaliphatic compound, aliphatic-substituted aromatic compound, cycloaliphatic-substituted aromatic compound, aliphatic-substituted cycloaliphatic compound, or mixture of two or more thereof.

18. The process of claim 1 wherein said organic solvent comprises an aromatic-rich solvent.

19. The process of claim 1 wherein said organic solvent comprises naphtha, gas oil, kerosene, fuel oil, cycle oil, decanted oil or a mixture of two or more thereof.

20. The process of claim 1 wherein said organic solvent comprises at least one light reformate.

21. The process of claim 1 wherein said organic solvent comprises at least one heavy reformate.

22. The process of claim 1 wherein said organic solvent comprises at least one natural gas condensate comprising hydrocarbons of about 6 to about 25 carbon atoms and having an aromatic and/or naphthene content of about 5% to about 90% by weight.

23. The process of claim 1 wherein at least about 50% by weight of said organic solvent boils at a temperature below about 750° F. at atmospheric pressure.

24. The process of claim 1 wherein said organic solvent has an initial boiling point in the range of about 0° F. to about 500° F. at atmospheric pressure, and a final boiling point in the range of about 200° F. to about 1000° F. at atmospheric pressure.

25. The process of claim 1 wherein said organic solvent has an initial boiling point in the range of about 50° F. to about 150° F. at atmospheric pressure, and a final boiling point in the range of about 200° F. to about 300° F. at atmospheric pressure.

26. The process of claim 1 wherein said organic solvent has an initial boiling point at atmospheric pressure in the range of about 300° F. to about 500° F., and a final boiling point at atmospheric pressure in the range of about 650° F. to about 950° F.

27. The process of claim 1 wherein said organic solvent has an initial boiling point at atmospheric pressure in the range of about 180° F. to about 280° F., and a final boiling point at atmospheric pressure in the range of about 325° F. to about 425° F.

28. The process of claim 1 wherein said organic solvent has an initial boiling point at atmospheric pressure in the range of about 200° F. to about 325° F., and a final boiling point at atmospheric pressure in the range of about 425° F. to about 525° F.

29. The process of claim 1 wherein said organic solvent comprises toluene.

30. The process of claim 1 wherein said organic solvent comprises n-hexene.

31. The process of claim 1 wherein said organic solvent comprises benzene, toluene, xylene, naphthalene, or a mixture of two or more thereof.

32. The process of claim 1 wherein the weight ratio of said organic solvent to said hydrocarbonaceous material is in the range of about 0.01:1 to about 10:1.

33. The process of claim 1 wherein the weight ratio of said organic solvent to said hydrocarbonaceous material is in the range of about 0.01:1 to about 3:1.

34. The process of claim 1 wherein the weight ratio of said organic solvent to said hydrocarbonaceous material is in the range of about 0.05:1 to about 1:1.

35. The process of claim 1 wherein the weight ratio of said organic solvent to said hydrocarbonaceous material is in the range of about 0.05:1 to about 0.5:1.

36. The process of claim 1 wherein the weight ratio of said organic solvent to said hydrocarbonaceous material is in the range of about 0.05:1 to about 0.3:1.

37. The process of claim 1 operated on a batch basis.

38. The process of claim 1 operated on a semibatch basis.

39. The process of claim 1 operated on a continuous basis.

40. The process of claim 1 wherein said product is removed from said enclosed space and at least part of said product is recycled to said enclosed space.

41. A process for upgrading a hydrocarbonaceous material having an initial boiling point of at least about 625° F. to a product having a lower boiling point than the initial boiling point of said hydrocarbonaceous material and/or a higher boiling point than the final boiling point of said hydrocarbonaceous material, the process comprising heating a mixture comprising said hydrocarbonaceous material and at least one organic solvent in an enclosed space in the absence of externally supplied water or hydrogen at a temperature in the range of about 950° F. to about 1300° F. and a pressure in excess of about 1500 psig for an effective period of time to yield said product, said pressure being sufficient to maintain the specific gravity of the contents of said enclosed space in the range of about 0.05 to about 1.5, said organic solvent being capable of dissolving at least about 10 parts of said hydrocarbonaceous material per million parts of said organic solvent at the temperature wherein at least about 50% by weight of said organic solvent boils at atmospheric pressure.

42. A process for upgrading a hydrocarbonaceous material having an initial boiling point in the range of about 700° F. to about 1100° F. to a product having a lower boiling point than the initial boiling point of said hydrocarbonaceous material and/or a higher boiling point than the final boiling point of said hydrocarbonaceous material, the process comprising heating a mixture of said hydrocarbonaceous material and toluene in an enclosed space in the absence of externally supplied water or hydrogen at a temperature in the range of about 7 about 1300° F. and a pressure in excess of about 1500 psig for an effective period of time to yield said product, said pressure being sufficient to maintain the specific gravity of the contents of said enclosed space in the range of about 0.05 to about 1.5.

43. A process for upgrading a hydrocarbonaceous material other than crude oil having an initial boiling point of at least about 625° F. to a product having a lower boiling point than the initial boiling point of said hydrocarbonaceous material and/or a higher boiling point than the final boiling point of said hydrocarbonaceous material, the process comprising heating a mixture comprising said hydrocarbonaceous material and at least one organic solvent in an enclosed space in the absence of externally supplied water or hydrogen at a temperature in the range of about 750° F. to about 1300° F. and a pressure in excess of about 1500 psig for an effective period of time to yield said product, said pressure being sufficient to maintain the specific gravity of the contents of said enclosed space in the range of about 0.05 to about 1.5, said organic solvent being capable of dissolving at least about 10 parts of said hydrocarbonaceous material per million parts of said organic solvent at the temperature wherein at least about 50% by weight of said organic solvent boils at atmospheric pressure.

* * * * *